US005082722A

United States Patent [19]

Guglielmo, Sr.

[11] Patent Number: 5,082,722

[45] Date of Patent: Jan. 21, 1992

[54] PROCESS FOR TREATING NETTING WITH AN ANTIFOULING COMPOSITION AND PRODUCT PRODUCED THEREBY.

[76] Inventor: Richard J. Guglielmo, Sr., Lambs Lane, Cresskill, N.J. 07626

[21] Appl. No.: 586,255

[22] Filed: Sep. 21, 1990

Related U.S. Application Data

[62] Division of Ser. No. 145,978, Jan. 20, 1988.

[51] Int. Cl.[5] ..... D06B 19/00

[52] U.S. Cl. ..... 428/255; 427/393.4; 427/394; 106/15.05; 106/18.32; 106/18.33; 106/2; 71/67; 424/409; 428/365

[58] Field of Search ..... 427/393.4, 394; 106/15.05, 18.32, 18.33, 18.34, 2; 514/373, 478, 595; 424/405, 409; 71/67; 428/365, 375, 377, 378, 255, 256

[56] References Cited

U.S. PATENT DOCUMENTS

| | | | |
|---|---|---|---|
| 4,010,141 | 3/1977 | Onozuka et al. | 106/18.33 |
| 4,082,884 | 4/1978 | DeLong | 427/407.1 |
| 4,127,687 | 11/1978 | Dupont | 106/18.32 |
| 4,276,211 | 6/1981 | Singer et al. | 106/18.32 |
| 4,323,602 | 4/1982 | Parker | 106/18.32 |
| 4,393,102 | 7/1983 | Guglielmo, Sr. | 427/243 |
| 4,661,400 | 4/1987 | Guglielmo, Sr. | 43/7 |
| 4,766,113 | 8/1988 | West et al. | 514/187 |
| 4,786,739 | 11/1988 | Chenard | 549/11 |
| 4,898,895 | 2/1990 | Masuoka et al. | 427/388.2 |

FOREIGN PATENT DOCUMENTS

| | | | |
|---|---|---|---|
| 59-176202 | 10/1984 | Japan | 106/18.32 |

*Primary Examiner*—Shrive Beck
*Assistant Examiner*—Terry J. Owens
*Attorney, Agent, or Firm*—Louis E. Marn

[57] ABSTRACT

An antifouling composition for use on nettings is comprised of a chloro isophthalic acid derivative, a benzothiazole derivative, 4,5 dichloro-2-N-octyl, isophthiazole-3-one, 3-iodo-2-propynyl butyl carbamate, (3-3,4 dichlorophenyl) 1,1 dimethyl urea and mixtures thereof in a water base system for controlling algae and marine organism growth on submerged netting for use in free flowing sea and/or fresh water.

18 Claims, No Drawings

PROCESS FOR TREATING NETTING WITH AN ANTIFOULING COMPOSITION AND PRODUCT PRODUCED THEREBY.

This is a division application Ser. No. 07/145,978, filed Jan. 20, 1988.

BACKGROUND OF THE INVENTION (1) Field of the Invention

This invention relates to a composition of matter and a process for using same, and more particulary to an antifouling composition of treating nets, and in particular aquaculture, fish cages and weir fishing nets which are stationary, undecorative fishing nets.

(2) Description of the Prior Art

It has been found that many types of nettings, exposed to sea and fresh waters, experience heavy levels of clogging due to algae and invertebrates. Such clogging limits the flow of water and deposited organisms on the net can cause weight increases as high as 1000 percent. Such a weight increase results in the sinking of the supported netting and fish escape as well as making it practically impossible to raise the netting for cleaning. In some instances, the cutting away of netting is necessitated, resulting in the loss of netting. In addition to netting losses, fish may also be lost or harmed. Salt and freshwater aquaculture systems have traditionally been plaqued by heavy fouling on nets, cages, intake pipes and aeration systems.

Nets, particularly, have suffered from heavy encrustation, making them inordinately heavy, and eventually incapable of permitting water flow-through. Natural food penetration, acceptable oxygen levels, removal of fish wastes and detritus removal are severly restricted, leading to loss of or poor crop yield. Labor for frequent cleaning adds high costs, and full cage utilization is not possible because of cage rotation during cleaning. Antifouling compounds have been used for centuries with only partial success. Traditional antifouling coating treatments have relied on copper oxide and mercury compounds and other heavy metal compounds which are effective antifoulants, but are highly toxic and can be damaging to systems in which live organisms are expected to survive.

In U.S. Pat. No. 4,393,102 to Guglielmo, Sr. there is disclosed a net finishing composition in a suitable solvent system which, when coated on a net substrate, particularly a nylon net substrate of a mesh size of from ¼ to 5 inches, substantially improves the integrity of the net substrate. The net fishing composition is comprised of a low molecular weight, high acetate content, vinyl chloride copolymer, a monomeric plasticizer, and a polymer plasticizer. The molecular weight of the copolymer is from 20,000 to 65,000 and of an acetate content of from 10 to 20 percent by weight. The plasticizers are present in an amount of from 40 to 60 parts, preferably 50 parts per 100 parts of the copolymer with the ratio on monomeric plasticizer to polymeric plasticizer ranging from about 1:1 to 3:1, preferably 2:1. It is also disclosed that antifouling properties could be improved by adding certain organo-tin esters dissolved or dispersed in the solvent system.

In U.S. Pat. No. 4,661,400 to Guglielmo, Sr. there is disclosed a net antifouling composition for use on nettings and comprised of from 2 to 10 percent, preferably 3 to 6 percent by weight of a tri-n-butyl tin ester selected from the group consisting of tri-n-butyl tin linoleate, bis(tri-n-butyl) tin succinate, tri-n-butyl tin benzoate, bis(tri-n-butyl) tin salicylate and mixtures thereof in an organic solvent system or a water base system, preferably a water base system, for controlling algae and invertebrate growth.

While the tri-n-butyl tin esters have proven to be exceedingly effective agents in antifouling compositions, the tri-n-butyl tins have demonstrated adverse ecological problems, particularly with respect to shellfish, notwithstanding the fact that the organo-tin esters are biodegradable to elemental tin, an element which is naturally occuring in the environment. Tin, along with copper, zinc and iron, is distributed in nature and in foods, such as fish flour rice, milk, seawater, etc. While copper oxide based paints, as well as tars, have been shown to result in high kill levels of fish fry as well as demonstrated carcinogenicity, the organo-tin compounds have not demonstrated like adverse effects on fish; however, they have adversely effected non-target shellfish. Accordingly, the E.P.A., and like governmental bodies of foreign countries, have placed the organo-tin compounds on the prohibitive list of active antifouling ingredients.

OBJECTS OF THE INVENTION

An object of the present invention is to provide a net antifouling composition of reduced ecological deficiencies and exhibiting substantial efficacy over extended periods of time after netting application.

Another object of the present invention is to provide a net antifouling composition of reduced ecological deficiencies and readily applied to a netting substrate.

Still another object of the present invention is to provide a net antifouling composition of reduced ecological deficiencies and which does not deleteriously affect fish harvest.

Yet another object of the present invention is to provide a net antifouling composition of reduced ecological deficiencies and which leaches out at a controlled rate from the net substrate.

Yet still another object of the present invention is to provide a net antifouling composition having a stabilized active ingredient as well as an active ingredient which is biodegradable when released into the environment.

A further object of the present invention is to provide a net antifouling composition of reduced ecological deficiencies and having a soft enough finish and being flexible which will not damage the fish when they brush against the treated netting.

Still yet another object of the present invention is to provide a net antifouling composition of reduced ecological deficiencies and capable of lowering operating costs resulting from the reduced labor time in cleaning and maintenance of the netting.

Another object of the present invention is to provide a net antifouling composition of reduced ecological deficiencies and reducible with water instead of flammable solvents or tar, allowing for simpler and safer application.

Still another object of the present invention is to provide an net antifouling composition of reduced ecological deficiencies and capable of protecting a treated net exposed to sunlight.

Still yet another object of the present invention is to provide a net antifouling composition of reduced ecological deficiencies and more resistant to abrasion.

SUMMARY OF THE INVENTION

These and other objects of the present invention are achieved by a net antifouling composition for use on nettings and comprised of a chloro isophthalic acid derivative, such as tetrachloro isophthalonitrile, a benzothiazole, such as 2(thiocyano methylthio) benzothiazole, 4,5 dichloro-2-N-octyl, 4 isophthiazole-3-one, 3-iodo-2-propynl butyl carbamate, (3-3,4 dichlorophenyl) 1,1 dimethyl urea and mixtures thereof, and preferably with a compound selected from the group comprised of zinc oxide, barium metaborate and clay in a water base system having a pH of between 7.8 to 8.8 with a ratio of active ingredient to filler maintained at about a ratio of 1:1 to 1:2. The active agent is present in an amount of from 2 to 12 percent by weight of the antifouling composition for application onto the netting substrate.

DETAILED DESCRIPTION OF THE INVENTION

The active ingredient of the system of the present invention is selected from the group consisting of chloro isophthalic acid derivative, such as tetrachloro isophthalonitrile; a benzothiazole, such as 2(thiocyano methylthio) benzothiazole; 4,5 dichloro-2-N-octyl, 4 isophthiazole-3-one; 3-iodo-2-propynyl butyl carbamate; (3-3,4 dichlorophenyl) 1,1 dimethyl urea and mixture thereof. When using a chloro isophthalic acid derivative, such as tetrachloro isophthalonitrile, to provide stability to such active ingredient in the composition, it is necessary to provide a pH level in the wet and dried coating of below about 9.0, preferably about 7.8 to 8.8. Additional supporting compounds are zinc oxide, modified barium metaborate, surfactants and clay form the antifouling composition. The active ingredient is present in the antifouling composition in an amount of from 2 to 12 percent, preferably 5 to 10 percent by weight in a water base system.

The essential component of the antifouling system is the active ingredient and filler, such as clay, in a ratio of from about 1:1 to 1:2 to the active ingredient and a surfactant in a ratio of about 1:5 to filler. Generally, the net treating antifouling composition is prepared by mixing water to a concentrate of the antifouling system, as more fully hereinafter discussed. The filler and surfactant helps to control the release of the active ingredient (leaching) as well as effect the wear factor, i.e. rate of exposure of new surface to permit functioning of the active ingredient. Leach out of the active ingredient should not exceed ½ the amount in any formula over an 8-12 month period. The leach out rate is effected by the presence of a surfactant, preferably a non-ionic surfactant. In preparation for treating the netting, the preservative concentrate is reduced with water to adjust the viscosity and solids so that dry weight pick-up on the netting is 35% or more.

The components of the water base system are, in addition to the active ingredient and fillers, binders (such as acrylic/vinyl latexes, styrene latex, styrene/acrylic latexes, vinyl chloride, vinyl chloride acetate; acrylonitrile latexes, and the like), wetting agents, suspending agents, coalescent agents, pigments, and water. The binders together with the other agents are also selected to control the leaching of the active ingredient system from the coating on the treated net.

In one embodiment of a net finishing composition of the present invention, the chloro isophthalic acid derivative, comprised of from 2 to 12 percent, preferably 5 to 10 percent by weight, is present with the benzothiazole compound in an amount of from 1 to 7 percent, preferably 2 to 5 percent by weight, and the mixture is dispersed in a water system, such that the solids content of the resulting antifouling composition is not less than about 30 percent by weight, and between 25 to about 40 percent solids, with a preferable solids range of about 30 to 35 percent by weight.

A method of application of the net antifouling composition of the present invention is achieved by dipping a net in a tank containing the antifouling composition. When the net is dipped in the tank, the submerged portion should be allowed to sit in the tank for at least 10 seconds up to 30 minutes, preferably approximately 3 to 5 minutes. The net treated with the antifouling composition is allowed to be cured on the net. The purpose of curing is that it allows for the vaporization or evaporation of the water and the absorption of the active ingredient into the net. The active ingredient system should be allowed to cure from about 12 to 96 hours, with a preferable curing time of 48 to 72 hours prior to use of the resulting netting. After the treated net is placed in the water, the treated net should be allowed to condition for at least about 72 hours before live fish are introduced into the aquasystem.

It has been found that a net treated with the antifouling composition and having a minimum weight pick-up of 35 percent on the net results in a coated net exhibiting, after a long term test period, effectiveness for controlling the marine growth up to a full season's use (4-12 mon.), whereas an untreated net will foul necessitating removal and cleaning/or replacing of the net resulting in the problem previously stated.

EXAMPLE OF THE INVENTION

The following example is illustrative of the present invention:

Example

Fish net or pearl nets, which can be nylon, polyethylene or polypropylene are treated in a water-based net antifouling composition of the components as set forth in Table I below:

TABLE I

| | Working Formulation Examples | | | | | | | |
|---|---|---|---|---|---|---|---|---|
| | Parts & Formulation | | | | | | | |
| Components | #1 | #2 | #3 | #4 | #5 | #6 | #7 | #8 |
| Water | 50.0 | 48.0 | 49.0 | 49.0 | 45.5 | 49.0 | 48.0 | 47.0 |
| Surfactants/dispersing agents | 1.0 | 1.0 | 1.0 | 1.0 | 1.0 | 1.0 | 1.0 | 1.0 |
| Barium meta borate | 5.0 | 8.0 | 4.0 | — | — | — | — | — |
| Zinc oxide | 5.0 | 3.0 | 6.0 | — | 5.0 | 1.5 | — | — |
| Acrylic latex at 50% solids | 30.0 | 30.0 | 30.0 | 30.0 | 30.0 | 30.0 | 30.0 | 30.0 |
| Coalesing Agent 1/1 | 3.0 | 3.0 | 3.0 | 3.0 | 3.0 | 3.0 | 3.0 | 3.0 |

TABLE I-continued

| Components | Working Formulation Examples Parts & Formulation #1 | #2 | #3 | #4 | #5 | #6 | #7 | #8 |
|---|---|---|---|---|---|---|---|---|
| ethylene glycol/ propolyene glycol | | | | | | | | |
| Pigment 100% solids | 3.0 | 3.0 | 3.0 | 3.0 | 3.0 | 3.0 | 3.0 | 3.0 |
| China clay (filler) | — | — | — | 6.0 | 4.0 | 7.0 | 6.6 | 5.5 |
| 2(thiocyano methylthio) benzothiozole | 1.0 | 4.0 | 4.0 | — | 1.5 | 0.5 | 0.5 | 0.5 |
| Tetrachloro isophthalo nitrile | 2.0 | — | — | 5.0 | 7.0 | 1.5 | — | — |
| (3-3,4 dichloro phenyl) 1,1 dimethyl urea | — | — | — | 3.0 | — | — | 5.0 | 5.0 |
| 3-iodo-2-propynyl butyl carbamate | — | — | — | — | — | 3.5 | 3.0 | — |
| 4,5-dichloro-2-N-octyl 4-isophthiazole-3-one | — | — | — | — | — | — | — | 5.0 |
| TOTAL | 100 | 100 | 100 | 100 | 100 | 100 | 100 | 100 |

The dispersion is introduced into a trough at ambient temperature. A fishing net having a mesh size in the range of from 0.25 to 5 inches is continuously introduced into the trough and withdrawn, such that incremental sections of net remain in the solution for from 10 seconds to 10 minutes, the net can be batched or bundled and dipped in a tank and allowed to drain.

The antifouling composition coated on the net dries to touch in about 4 to 6 hours and can be handled. The net antifouling composition is permitted to cure on the net for a minimum period of approximately 72 hours t ambient temperature before net usage (cooler winter temperature drying will take longer). As hereinabove discussed, after the treated net is placed in the water, the treated net should be allowed to condition for 72 hours before contact with live fish.

While the present invention has been described in connection with an exemplary embodiment thereof, it will be understood that many modifications will be apparent to those of ordinary skill in the art and that this application is intended to cover any adaptations or variations thereof. Therefore, it is manifestly intended that this invention be only limited by the claims and the equivalents thereof.

What is claimed is:

1. An aquaculture substrate coated with an antifouling composition comprised of a chloro isophthalic acid derivative present in an amount of from 5 to 10 percent by weight and a benzothiazole present in an amount of from 2 to 5 percent by weight in said antifouling composition.

2. The aquaculture substrate as defined in claim 1 wherein said chloro isophthalic acid derivative is tetrachloro isophthalonitrile.

3. The aquaculture substrate as defined in claim 1 wherein said benzothiazole is 2(thiocyano methylthio) benzothiazole.

4. The aquaculture substrate as defined in claim 1 and further including a filler in said antifouling composition to control leach out of said chloro isophthalic acid derivative.

5. The aquaculture substrate as defined in claim 1 having a solids content of from 30 to about 50 percent solids by weight.

6. The aquaculture substrate as defined in claim 4 wherein said filler is clay and is present in a weight ratio of about 1:1 to said chloroisophthalic acid derivative.

7. The aquaculture substrate as defined in claim 6 and further including a surfactant in said antifouling composition.

8. The aquaculture substrate as defined in claim 7 wherein said surfactant is a non-ionic surfactant.

9. A process for treating an aquaculture substrate which comprises coating said aquaculture substrate with an antifouling composition comprised of a chloro isophthalic acid derivative present in an amount of from 5 to 10 percent by weight, and a benzothiazole present in an amount of from 2 to 5 percent by weight in said antifouling composition.

10. The process as defined in claim 9 wherein said chloro isophthalic acid derivative is tetrachloro isophthalonitrile.

11. The process as defined in claim 9 wherein said benzothiazole is 2(thiocyano methylthio) benzothiazole.

12. The process as defined in claim 9 and further including a filler in said antifouling composition to control leach out of said chloro isophthalic acid derivative.

13. The process as defined in claim 9 wherein said antifouling composition has a solids contents of from 30 to about 50 percent solids by weight.

14. The process as defined in claim 12 wherein said filler is clay and is present in a weight ratio of about 1:1 to said chloro isophthalic acid derivative.

15. The process as defined in claim 14 and further including a surfactant in said antifouling composition.

16. The process as defined in claim 15 wherein said surfactant is a non-ionic surfactant.

17. The process as defined in claim 9 wherein said aquaculture substrate is dried after coating for a period of about 72 hours.

18. The process as defined in claim 17 wherein drying is effected at ambient temperatures.

* * * * *